US006161744A

United States Patent [19]

Mukoyama et al.

[11] Patent Number: 6,161,744

[45] Date of Patent: Dec. 19, 2000

[54] FASTENER TOOL SUPPORT

[75] Inventors: Kenji Mukoyama; Takahiro Sakaguchi; Junichi Iwakami, all of Anjo, Japan

[73] Assignee: Makita Corporation, Anjo, Japan

[21] Appl. No.: 09/342,923

[22] Filed: Jun. 30, 1999

[30] Foreign Application Priority Data

Jul. 1, 1998 [JP] Japan ..... 10-186279

[51] Int. Cl.[7] ..... B25C 1/04

[52] U.S. Cl. ..... 227/8; 227/120; 227/130; 227/156; D8/68

[58] Field of Search ..... 227/8, 130, 120, 227/156, 136, 151, 140, 148; D8/68, 69

[56] References Cited

U.S. PATENT DOCUMENTS

| | | | |
|---|---|---|---|
| D. 334,329 | 3/1993 | Ogawa et al. | D8/68 |
| D. 403,938 | 1/1999 | Matsuoka et al. | D8/68 |
| 3,106,136 | 10/1963 | Langas et al. | 227/130 |
| 3,360,176 | 12/1967 | Gehl et al. | 227/156 |
| 4,196,833 | 4/1980 | Haytayan | 227/8 |
| 4,523,646 | 6/1985 | Doyle et al. | 227/8 |
| 4,630,766 | 12/1986 | Steeves et al. | 227/8 |
| 5,054,678 | 10/1991 | Nasiatka | 227/8 |
| 5,118,023 | 6/1992 | Fushiya et al. | 227/8 |
| 5,251,371 | 10/1993 | Powers | 227/156 |
| 5,267,682 | 12/1993 | Okouchi | 227/120 |
| 5,628,445 | 5/1997 | Braddock et al. | 227/120 |
| 5,862,970 | 1/1999 | Cougar | 227/130 |

FOREIGN PATENT DOCUMENTS 2539886 5/1993 Japan .

*Primary Examiner*—Peter Vo
*Assistant Examiner*—Jun Calve
*Attorney, Agent, or Firm*—Dennison, Scheiner, Schultz & Wakeman

[57] ABSTRACT

A fastener tool includes a body having a driver guide mounted thereon. The driver guide extends downwardly from the body and has a longitudinal axis in a driving direction of fasteners. A control member may be movably mounted on the body for controlling a fastener driving operation. A support leg device serves to permit the tool to be placed on a surface in an upright position, in which the driver guide extends substantially vertically relative to the surface. The support leg device defines a predetermined support area extending in a plane for abutment with the surface. The support leg device is arranged such that the tool center of gravity is positioned directly above the support area in a plan view when the tool is in the upright position, in which the support area extends substantially horizontally, so that the control member does not substantially interfere with the surface.

17 Claims, 3 Drawing Sheets

FASTENER TOOL SUPPORT

BACKGROUND OF THE INVENTION

1. Field of the Invention

The present invention relates to a fastener tool that can drive fasteners, such as nails and staples, into a workpiece or other structure.

2. Description of the Related Art

Known fastener tools include a body having a drive mechanism for reciprocally moving a driver. A driver guide is mounted on and extends downward from the body and has a guide channel formed therein for supporting the driver. Fasteners are serially supplied from a magazine into the driver guide by means of a fastener feeding device. The fasteners are then driven by the driver through the open lower end of the driver guide. A handle is mounted on and extends substantially horizontally from the body. A contact arm is vertically slidably mounted on the driver guide and is operably connected to a trigger that allows the operator to control the operation of the drive mechanism. The magazine has a substantially cylindrical configuration, is disposed below the handle and is connected to the rear side of the driver guide via the fastener feeding device. The magazine can store paper or wire-collated strip nails in a coiled configuration.

When the fastener tool is not being used, the operator may conveniently place the tool in an upright position on the floor or the surface of the workpiece. As a result, the driver guide is substantially vertically relative to the floor and the operator can readily grasp the handle in a substantially horizontal position to restart the driving operation. However, when placed in the upright position, the lower end of the contact arm and a rear peripheral edge of the bottom of the magazine will serve as a support leg device. The contact arm will be generally held in a position to extend downwardly from the lower end of the driver guide by the biasing force of a spring.

In order to maintain such a fastener tool in a stable upright position, Japanese Utility Model Registration No. 2,539,886 teaches a magazine having two downward protrusions on the bottom of the magazine, which protrusions are spaced laterally from each other. As a result, the two protrusions on the magazine and the lower end of the contact arm form three vertexes of a triangle and the tool center of gravity is located within the triangle when the fastener tool is in the upright position.

According to this reference, the tool can be placed on the floor or workpiece surface with improved stability. However, the lower end of the contact arm serves as one of the support legs. Thus, if the contact arm accidentally presses the floor or the workpiece surface when the tool is in this position, the contact arm could be sufficiently lifted to permit actuation of the trigger to start the drive mechanism of the driver. As a result, a nail may be inappropriately driven into the workpiece or floor. Therefore, in this design, the contact arm may not properly perform its function of preventing nails from being accidentally driven into the floor or the workpiece surface.

SUMMARY OF THE INVENTION

It is, accordingly, an object of the invention to provide improved fastener tools.

Preferably, a fastener tool is taught which overcomes the problem of accidentally driving fasteners into the floor or workpiece when the operator has temporally stored the fastener tool in the upright position. In one representative aspect, a support leg is provided in a position to permit the contact arm of a fastener guide to contact the workpiece surface, but the support leg supports the weight of the fastener tool, instead of the contact arm. Therefore, the possibility of inappropriately moving the contact arm, while the fastener tool is in a resting position, can be eliminated or at least substantially reduced.

More preferably, first, second and third support legs are provided on the fastener tool. The first support leg is disposed closest to the contact arm. The second and third support legs may be positioned rearward of the first support leg, so that the support area for the fastener tool in the upright position has a triangular configuration with its vertexes at the first, second and third support legs. In this design, the fastener tool center of gravity is within the triangle formed by the three support legs, the fastener tool is stable when placed in the upright position and the risk of an inappropriate fastener discharge is minimized.

Other objects, features and advantages of the present invention will be readily understood after reading the following detailed description together with the accompanying drawings and the claims.

DETAILED DESCRIPTION OF THE INVENTION

Figure 1:
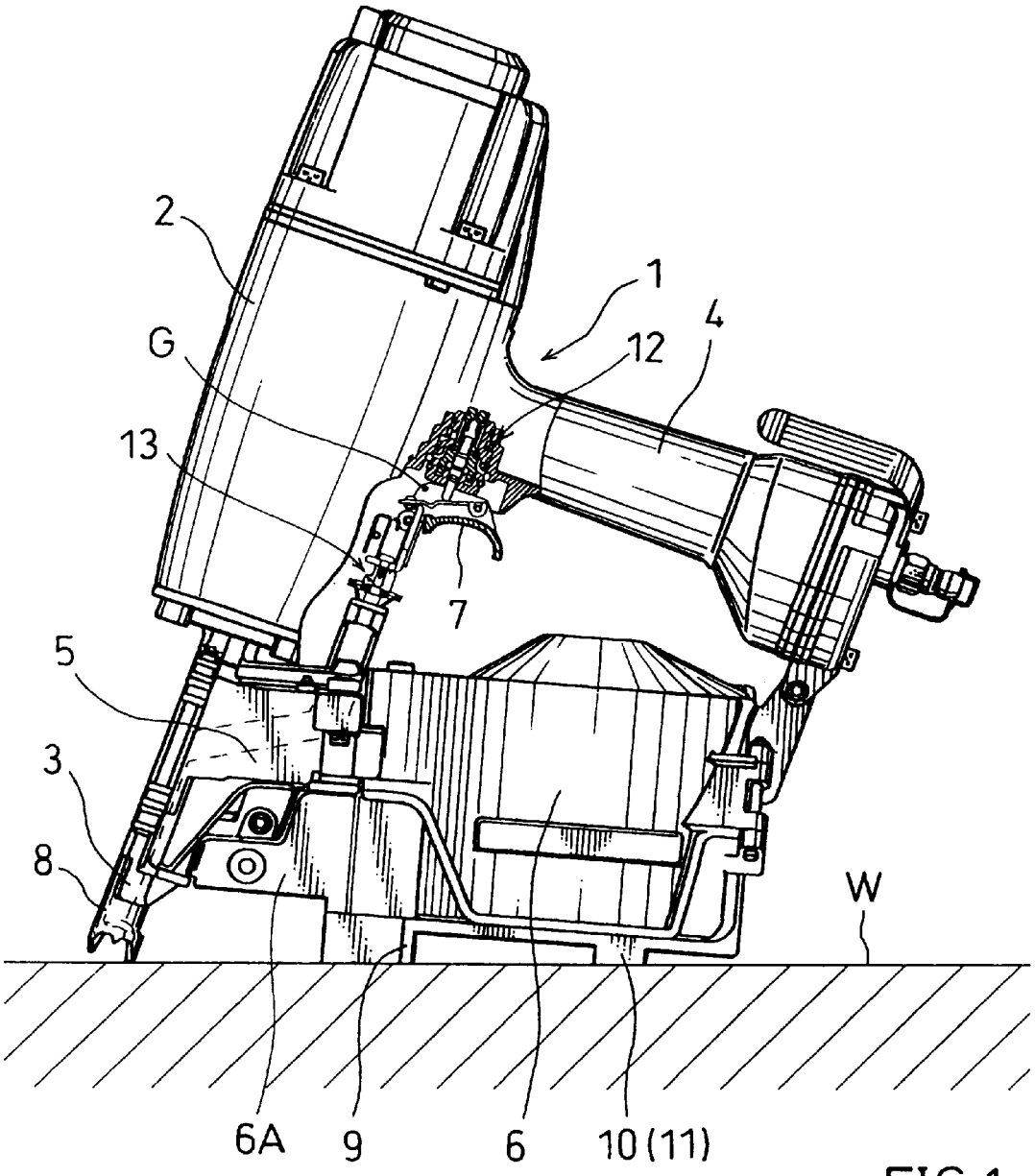
FIG. 1 is a side view of a representative embodiment of a fastener tool according to the present teachings.

Preferably, a fastener tool includes a fastener driver and a driver guide mounted on a body or housing. The driver guide may extend outwardly from the body and may serve to guide the fasteners from the driver into the workpiece. A control member may be movably mounted on the body to control the fastener driving operation, in conjunction with a trigger located on the body. A support leg device is preferably disposed on or about the fastener tool to permit the fastener tool to be placed on a surface in a stable, upright position. The driver guide may extend in substantially vertical direction relative to the surface, when the fastener tool is placed in the upright position. The surface may be any surface that the fastener tool contacts when stored in the upright position and may include for example, a floor, a workpiece surface or a bench surface, etc. The support leg device preferably defines a predetermined support area extending in a plane parallel to the surface and is preferably disposed such that the fastener tool center of gravity is located in the vertical section extending directly above the support area when the fastener tool is in the upright position. Further, while the control member preferably contacts the surface, it does not forcibly contact the surface.

As a result, the fastener tool can be stored in a stable upright position, without having the control member substantially contact the surface and thereby possibly interfere with the fastener driving operation. Therefore, accidental fastener discharges can be reliably prevented.

In a representative embodiment, the support leg device comprises first, second and third support legs. The first support leg is disposed closest to the control member. The second and third support legs may be positioned rearward of the first support leg, so that the support area has a triangular configuration with its vertexes at the first, second and third support legs.

Preferably, the fastener tool has a magazine for storing strip fasteners, and at least one support leg is disposed on the magazine. The magazine may have a substantially cylindrical configuration with a circular bottom surface. This magazine configuration enables the support leg device to include first, second and third support legs provided on the bottom surface of the magazine and to be spaced from each other in the circumferential direction of the bottom surface. With this arrangement, the support leg device can be easily and readily incorporated into the tool.

In addition, the tool may have a cover extending between the driver guide and the magazine to cover the fasteners that are being fed from the magazine to the driver guide. In such a case, the support leg device may include first and second support legs provided on the magazine and a third support leg provided on the cover.

The control member may be a contact arm that is movable along the driver guide between an upper position and a lower position. When the contact arm is in the lower position, it may serve to prevent a fastener driving operation. When the contact arm is in the upper portion, it may serve to permit the fastener driving operation. Preferably, the contact arm has a lower end that is positioned at the same level as the support area of said support leg device or above the support area when the tool is in the upright position, in which the support area extends substantially horizontally.

Each of the additional features and method steps disclosed above and below may be utilized separately or in conjunction with other features and method steps to provide to provide improved fastener tools and methods for designing and using such fastener tools. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative and representative examples of the invention, which detailed description will now be given of two representative examples with reference to the accompanying drawings.

FIG. 1 is a side view of the first representative embodiment of a fastener tool 1. The fastener tool 1 generally comprises a body or housing 2, a driver guide 3, a handle 4, a fastener feeding device 5 and a magazine 6. The fastener feeding device may feed, for example, nails or staples. A drive mechanism (not shown) may be disposed within the body 2, which drive mechanism can include a cylinder and a piston that is reciprocally driven within the cylinder by compressed air supplied to the cylinder. The driver guide 3 may be mounted on the body 2 so as to extend downwardly therefrom. The driver guide 3 may have a guide channel (not shown) formed therein, so that a driver (not shown) connected to the piston can be reciprocally moved within the guide channel to serially drive fasteners out of the driver guide 3 and through the open lower end of the driver guide 3. Thus, the driver guide 3 has a longitudinal axis in a fastener direction. The handle 4 may be connected to the rear side of the body 2 so as to extend substantially orthogonal to the longitudinal axis of the driver guide 3. The fastener feeding device 5 may be mounted on the lateral side of the driver guide 3 and may serve to feed fasteners from the magazine 6 into the driver guide 3. The magazine 6 may be supported between the fastener feeding device 5 and the rear or bottom end of the handle 4.

The magazine 6 may have a substantially cylindrical configuration and may have a central axis that is inclined by a small angle relative to the longitudinal axis of the driver guide 3. The magazine 6 stores the fasteners, such as nails, in the form of a wire-collated strip and the strip is preferably coiled within the magazine 6.

A trigger valve 12 may be mounted within the body 2 at a connecting portion to the handle 4 and may serve to control the supply of the compressed air to the drive mechanism. A trigger 7 may be pivotally mounted on the body 2 adjacent to the trigger valve 12. The trigger 7 may be operable by an operator to turn on and off the trigger valve 12. Thus, the trigger valve 12 is turned on when the operator pulls the trigger 7. Other means for controlling the drive mechanism of course may be utilized.

A contact arm 8 may be slidably mounted on the driver guide 3 in a manner that permits the contact arm 8 to move along the longitudinal axis of the driver guide 3. The contact arm 8 may be normally biased by a spring (not shown) so as to be held in a lowermost position. Preferably, the lower end of the contact arm 8 extends downwardly beyond the lower open end of the driver guide 3 as shown in FIG. 1. The upper end of the contact arm 8 may be connected to a trigger control mechanism 13. When the contact arm 8 is in the lowermost position, the trigger control mechanism 13 can prevent the trigger 7 from being pulled or actuated by the operator. On the other hand, when the operator presses the contact arm 8 against a workpiece (not shown), the contact arm 8 may be lifted or move away from its lowermost position along the driver guide 3 against the biasing force of the spring. In this state, the trigger control mechanism 13 may permit the trigger 7 to be pulled or actuated by the operator. Thus, the contact arm 8 can function as a control member to only permit the trigger 7 to be pulled or actuated when the operator intends to drive a fastener into a workpiece.

Figure 2:
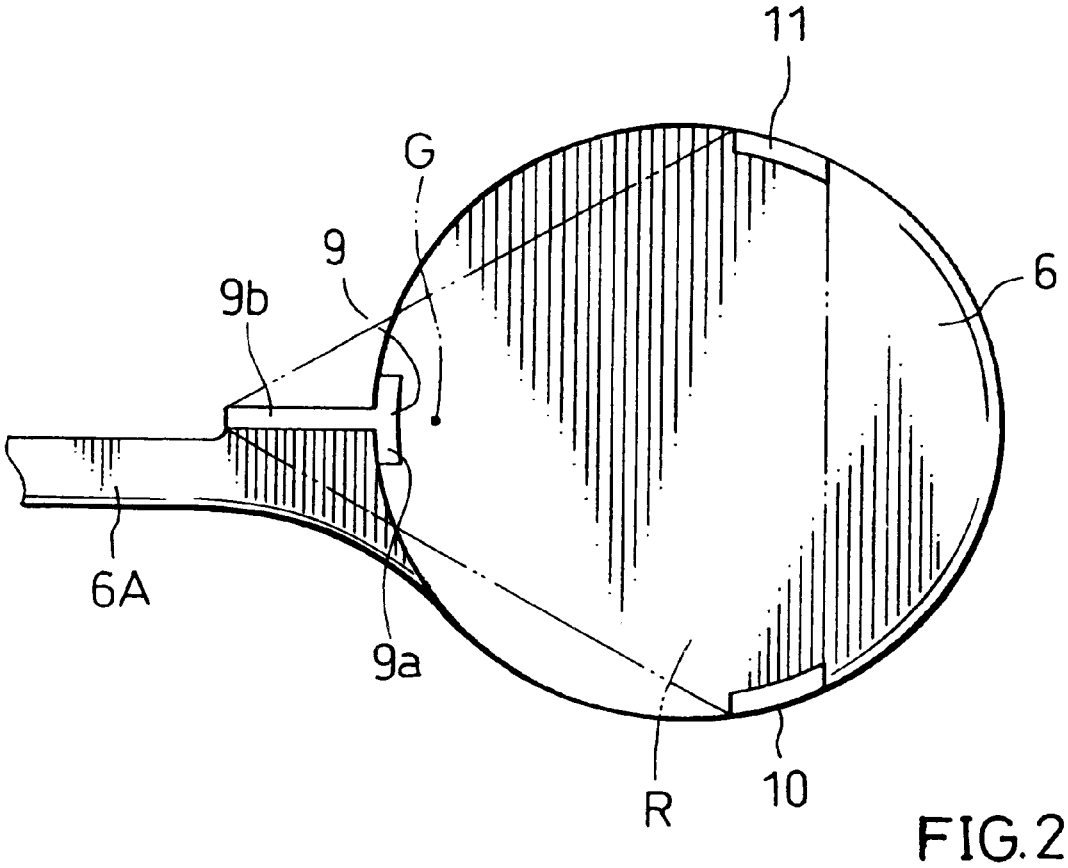
FIG. 2 is a bottom view of a fastener tool magazine showing a support leg device having three support legs.

As shown in FIGS. 1 and 2, a first support leg 9, a second support leg 10 and a third support leg 11 may be integrally formed with the circular bottom of the magazine 6 and may extend downwardly therefrom. The first support leg 10 may be positioned forwardly (closest to the driver guide 3) of the second support leg 10 and the third support leg 1. The second support leg 10 and the third support leg 11 may be positioned in alignment with each other in the lateral direction such that the first, second and third support legs 9, 10 and 11 are spaced substantially equally from each other in the circumferential direction of the bottom surface of the magazine 6. In particular, the lower ends of the support legs 9, 10 and 11 may define a support area R that has a substantially triangular configuration with its vertexes at the support legs 9, 10 and 11 as shown in FIG. 2. Most importantly, the center of gravity G of the entire fastener tool is positioned above the support area R when the tool is in an upright position, as shown in FIG. 1. Thus, in the upright position, the support area R extends horizontally and is preferably flush with surface W, so that the lower ends of the support legs 9, 10 and 11 contact the surface W.

Further, in the upright position shown in FIG. 1, the lower end of the contact arm 8 contacts the surface W, but is not pressed against the surface W. Thus, the lower end of the contact arm 8 does not serve as a weight-bearing support for the tool. Therefore, the contact arm 8 remains in the lowermost position when the fastener tool 1 is stored in the upright, position and the surface W does not interfere with or bias the contact arm 8.

Although the lower end of the contact arm 8 contacts the surface W in this representative embodiment, the lengths of the support legs 9, 10 and 11 may be determined such that the horizontal plane of the support area R is below the lower end of the contact arm 8, when the contact arm 8 is in the lowermost position. In this arrangement, the lower end of the contact arm 8 will be separated from the surface W when the tool is placed on the surface W in the upright position shown in FIG. 1.

Further, as shown in FIGS. 1 and 2, a cover plate 6A may be integrally formed with the front portion of the magazine 6 and adjacent to the fastener feeding device 5. Preferably, the cover plate 6A extends forwardly from the magazine 6 to the driver guide 3 and serves as a side safety cover to cover the lower portions of the fasteners that are fed by the fastener feeding device 5 from the magazine 6. A part of the cover plate 6A adjacent to the magazine 6 may extend downwardly to form a substantially straight leg part 9*a* of the first support leg 9. Thus, the first support leg 9 may have a substantially T-shaped configuration in bottom view as shown in FIG. 2 formed from a leg part 9*b* and an arc-shaped leg part 9*a* that extends along the periphery of the bottom surface of the magazine 6.

As described above, according to the representative embodiment shown in FIGS. 1 and 2, the fastener tool can be placed on the surface W without the surface W interfering with or biasing the contact arm 8. Therefore, the contact arm 8 can be reliably prevented from accidental upward movement, which may cause the trigger control mechanism 13 to actuate and cause a fastener to be discharged from the fastening tool at an inappropriate time.

Figure 3:
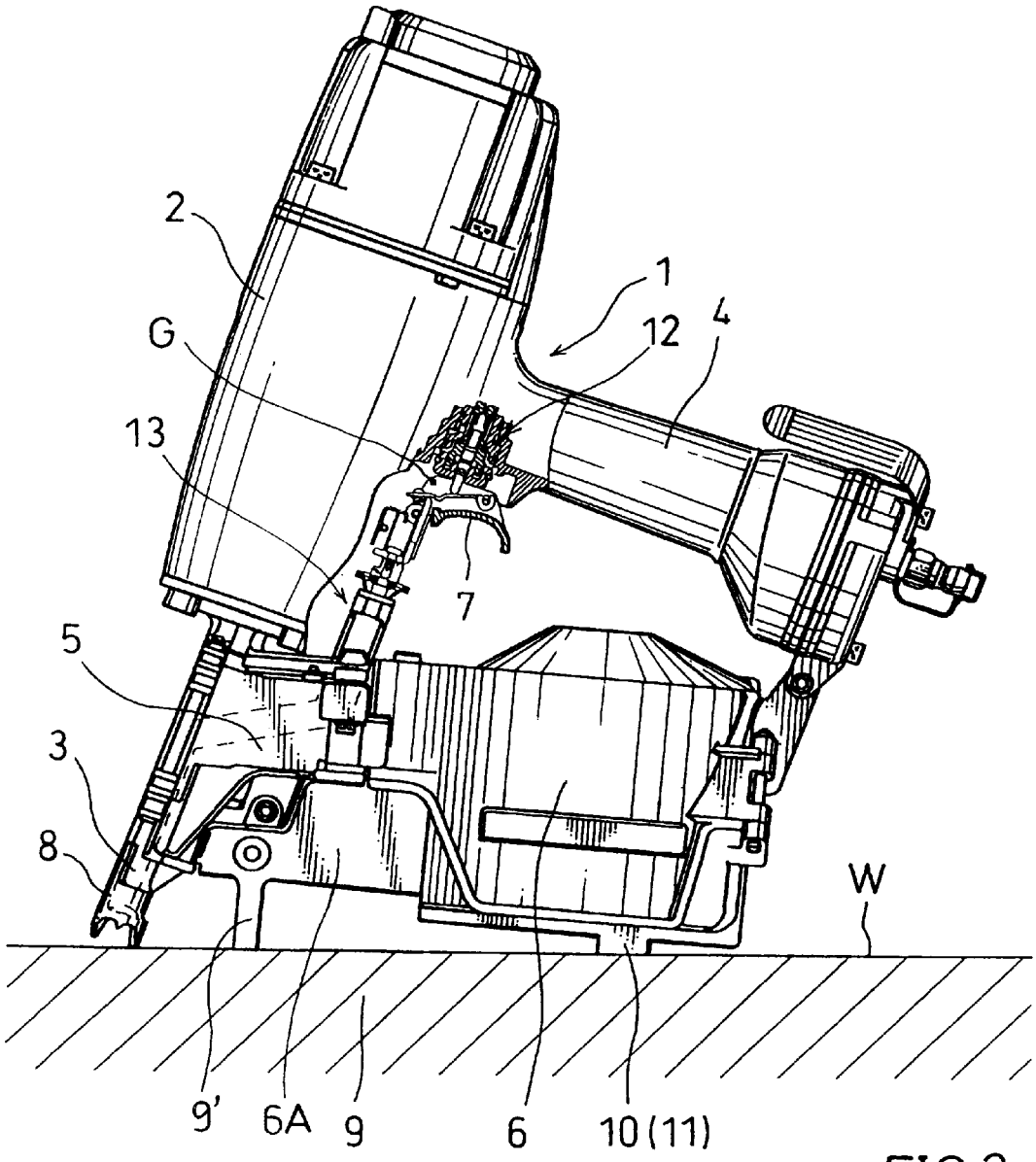
FIG. 3 is a side view of an alternative embodiment of a fastener tool according to the present teachings.

Although the first to third support legs 9 to 11 are formed on the magazine 6 in the above representative embodiment, the first support leg 9 may be instead formed, for example, on the cover plate 6A. Such an alternative embodiment is shown in FIG. 3, in which a first support leg 9' is integrally formed with the cover plate 9A. The first support leg 9' is spaced forwardly from the magazine 6 and extends downwardly from the cover plate 9A.

In addition, although the second and third support legs 10 and 11 are separated from each other in the above representative embodiments, they may be connected to form an integral arc-shaped leg.

Further, although the cover plate 6A is integrally formed with the magazine 6 in the above representative embodiments, the cover plate 6A may be formed as a separate member from the magazine 6.

We claim:

1. A fastener tool comprising:

a housing;

a driver guide mounted on the housing and extending from the housing to provide a longitudinal axis in a fastener driving direction;

a control member disposed on the driver guide and movable relative to the housing, the control member controlling a fastener driving operation; and a support leg device for abutting a surface when the fastener tool is placed in an upright position, in which upright position the driver guide extends substantially vertically relative to the surface, said support leg device defining a support area extending in a plane parallel to the surface when the fastener tool is in the upright position;

said support leg device being arranged such that the tool center of gravity is positioned above said support area so that the fastener tool is stably held in said upright position by said support leg device without any other support and the surface does not substantially interfere with or bias the control member when the fastener tool is in said upright position, wherein said support leg device comprises a first support leg, a second support leg and a third support leg, said second and third support legs being positioned on the side of said first support leg opposite said driver guide, and wherein said support area has a triangular configuration with its vertexes at said first, second and third support legs and the gravity center is positioned within the triangular support area.

2. A fastener tool as defined in claim 1 further comprising a magazine for storing strip fasteners, and wherein said support leg device includes at least one support leg provided on said magazine.

3. A fastener tool as defined in claim 2 wherein said magazine has a substantially cylindrical configuration with a circular bottom surface, and wherein said support leg device includes first, second and third support legs provided on said magazine bottom surface and spaced from each other in the circumferential direction of said magazine bottom surface.

4. A fastener tool as defined in claim 2 further including a cover extending between said driver guide and said magazine for laterally covering fasteners that are fed from said magazine to said driver guide, and wherein said support leg device includes first and second support legs provided on said magazine and a third support leg provided on said cover.

5. A fastener tool as defined in claim 1 wherein said control member comprises a contact arm that is movable along said driver guide between an uppermost position and a lowermost position, said contact arm in said lowermost position being operable to prevent the fastener driving operation, and said contact arm in said uppermost portion being operable to permit the fastener driving operation.

6. A fastener tool as defined in claim 5 wherein said contact arm has a lower end that is positioned at the same level as said support area of said support leg device or above said support area when the tool is in the upright position, in which said support area extends substantially horizontally.

7. A fastener tool comprising:

a housing;

means for guiding fasteners mounted on the housing and extending from the housing to provide a longitudinal axis in a fastener driving direction;

means for controlling a fastener driving operation movably mounted on the fastener guiding means; and means for supporting the fastener tool when the fastener tool is placed on a surface in an upright position, the fastener tool supporting means defining a support area extending in a plane parallel to the surface when the fastener tool is in the upright position, wherein the fastener tool has a center of gravity that is positioned above the support area so that the fastener tool is stably held in said upright position by said support leg device without any other support and the surface does not substantially interfere with or bias the control means when the fastener tool is in the upright position, wherein said support leg device comprises a first support leg, a second support leg and a third support leg, said second and third support legs being positioned on the side of said first support leg opposite said driver guide, and wherein said support area has a triangular configuration with its vertexes at said first, second and third support legs and the gravity center is positioned within the triangular support area.

8. A fastener tool as defined in claim 7 further comprising a magazine for storing strip fasteners and wherein the first support leg is provided on said magazine.

9. A fastener tool as defined in claim 8 wherein the magazine has a substantially cylindrical configuration with a circular bottom surface, and wherein the first, second and third support legs are provided on said magazine bottom surface and are separated from each other in the circumferential direction of said magazine bottom surface.

10. A fastener tool as defined in claim 9 wherein the control means comprises a contact arm that is movable along the fastener guiding means between an uppermost position and a lowermost position, when the contact arm is in the lowermost position, the fastener driving operation is prevented and when the contact arm is in the uppermost portion, the fastener driving operation is enabled.

11. A fastener tool as defined in claim 10 wherein the contact arm has a lower end that is positioned at the same level or above the surface when the tool is in the upright position.

12. A fastener tool as defined in claim 7 further comprising a magazine for storing strip fasteners and a means for laterally covering fasteners that are fed from the magazine and extending between the fastener guiding means and the magazine, wherein the first support leg is provided on the covering means and the second and third support legs are provided on a bottom surface of the magazine.

13. A fastener tool as defined in claim 12 wherein the control means comprises a contact arm that is movable along the fastener guiding means between an uppermost position and a lowermost position, when the contact arm is in the lowermost position, the fastener driving operation is prevented and when the contact arm is in the uppermost portion, the fastener driving operation is enabled.

14. A fastener tool as defined in claim 13 wherein the contact arm has a lower end that is positioned at the same level or above the surface when the tool is in the upright position.

15. An apparatus for applying fasteners to a workpiece, comprising:

a housing;

a fastener guide means mounted on the housing and extending from the housing to provide a longitudinal axis in a fastener driving direction;

a fastener driving operation control means movably mounted on the fastener guide means and comprising an actuator that can enable and disable the fastener driving operation; and a fastener tool support means having at least one support leg that stably supports the fastener tool when the fastener tool is placed on a surface in an upright position, the fastener tool support means defining a support area extending in a plane parallel to the surface when the fastener tool is in the upright position, wherein the apparatus has a center of gravity that is positioned above the support area so that the fastener tool is stably held in said upright position by said support leg device without any other support and the surface does not substantially interfere with or bias the fastener driving operation control means when the fastener tool is in the upright position, wherein said support leg device comprises a first support leg, a second support leg and a third support leg, said second and third support legs being positioned on the side of said first support leg opposite said driver guide, and wherein said support area has a triangular configuration with its vertexes at said first, second and third support legs and the gravity center is positioned within the triangular support area.

16. An apparatus as defined in claim 15 further comprising a magazine having a substantially cylindrical configuration with a circular bottom surface, wherein the first, second and third support legs are provided on said magazine bottom surface and are separated from each other in the circumferential direction of said magazine bottom surface.

17. An apparatus as defined in claim 16 wherein the fastener driving operation control means comprises a contact arm that is movable along the fastener guide means between an uppermost position and a lowermost position, when the contact arm is in the lowermost position, the fastener driving operation is prevented and when the contact arm is in the uppermost portion, the fastener driving operation is enabled and the contact arm has a lower end that is positioned at the same level or above the surface when the tool is in the upright position.

* * * * *